US007740550B1

(12) United States Patent
Kaufman

(10) Patent No.: US 7,740,550 B1
(45) Date of Patent: Jun. 22, 2010

(54) TENNIS THROW TRAINER

(75) Inventor: Alexander Kaufman, 715 Willoughby Way, Aspen, CO (US) 81611

(73) Assignee: Alexander Kaufman, Aspen, CO (US)

( * ) Notice: Subject to any disclaimer, the term of this patent is extended or adjusted under 35 U.S.C. 154(b) by 0 days.

(21) Appl. No.: 12/423,237

(22) Filed: Apr. 14, 2009

(51) Int. Cl.
*A63B 69/38* (2006.01)

(52) U.S. Cl. ..... 473/459

(58) Field of Classification Search ..... 473/459, 473/461, 462, 473, 474
See application file for complete search history.

(56) References Cited

U.S. PATENT DOCUMENTS 4,023,798 A * 5/1977 Pronin ..... 473/462
4,141,550 A * 2/1979 Denizman ..... 473/462
4,502,685 A * 3/1985 Phillips et al. ..... 473/462
5,011,143 A * 4/1991 Jones ..... 473/459

FOREIGN PATENT DOCUMENTS

FR 2609405 A1 * 7/1988

OTHER PUBLICATIONS http://www.mansionselect.com.
http://www.mansionselect.com/tennistraining.html.
http://www.mansionselect.com/tennis-serves-training-equipment-toss-trainer.html.

* cited by examiner

*Primary Examiner*—Raleigh W. Chiu
(74) *Attorney, Agent, or Firm*—McCarter & English, LLP; Michael I. Wolfson

(57) ABSTRACT

A training device that will train a player to throw the ball to the correct height and angle for a serve is provided. The device includes a pole that adjusts from about four feet to twelve feet in height to suit a player's need. The pole is supported by a base and includes an upper toss hoop at the top of the pole and a lower guide hoop at the bottom of the pole for receiving and locating the position of the tossed tennis ball. In one embodiment the lower guide hoop includes or is replaced by a basket for retrieving the tossed practice balls. The base legs and upper and lower hoops fold away for easy storage and transport.

11 Claims, 3 Drawing Sheets

TENNIS THROW TRAINER

BACKGROUND OF THE INVENTION

The invention relates generally to a tennis throw training device for improving a tennis player's serve by giving the player a correct throw, and more particularly to a device having an hoop of variable height from the ground used as a guide for the player to throw the ball during a serve.

There are various tennis training devices currently on the market. One such device that seeks to improve a tennis player' toss during a serve relies on having a coach to hold a training hoop at a correct height above the student's head. The student then tosses the ball during a serve through the training hoop.

Notwithstanding the availability of such tennis training devices, there exists the need to provide a device that will allow tennis players to improve on their own, or practice any time alone.

SUMMARY OF THE INVENTION

Generally speaking, in accordance with the invention, a tennis throw training device that will train a player to throw a tennis ball to the correct height and angle for a serve is provided. The device includes a pole that adjusts from about four feet to twelve feet in height to suit a player's need. The pole includes a upper toss hoop mounted to the top of the pole and a lower guide hoop mounted to the bottom of the pole for receiving and locating the position of the tossed tennis ball. In one embodiment of the invention, the lower guide hoop includes or is replaced by a basket or container for retrieving the tossed practice balls when thrown correctly.

The upper toss hoop is located at the correct height and horizontal position for a player who throws the ball up during a serve. To ensure that the ball travels strictly vertically, the lower guide hoop is positioned directly below the upper guide hoop. The lower guide hoop may be larger than the upper toss hoop. This is to insure that the ball not only reaches the correct height by passing through the upper toss hoop, but is tossed correctly in the vertical direction so that it will land in the lower guide hoop. This will insure that the ball will be in the correct horizontal position to connect with the racket.

Accordingly, it is an object of the invention to provide a device to guide a tennis player in throwing a tennis ball to the correct height and location for a serve.

It is another object of the invention to provide a tennis serve training device that does not require a coach or second person to hold the device during practice.

It is a further object of the invention to provide a training device that is suitable for players of varying height.

It is yet another object of the invention to provide a training device having a photo-sensor to indicate that the tennis ball has been tossed to the correct height and position.

It is yet further object of the invention to provide a training device having a container for capturing the tennis balls used during training.

Still another object of the invention to provide a training device that is easily collapsible for storage after training.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION OF THE INVENTION

Figure 1:
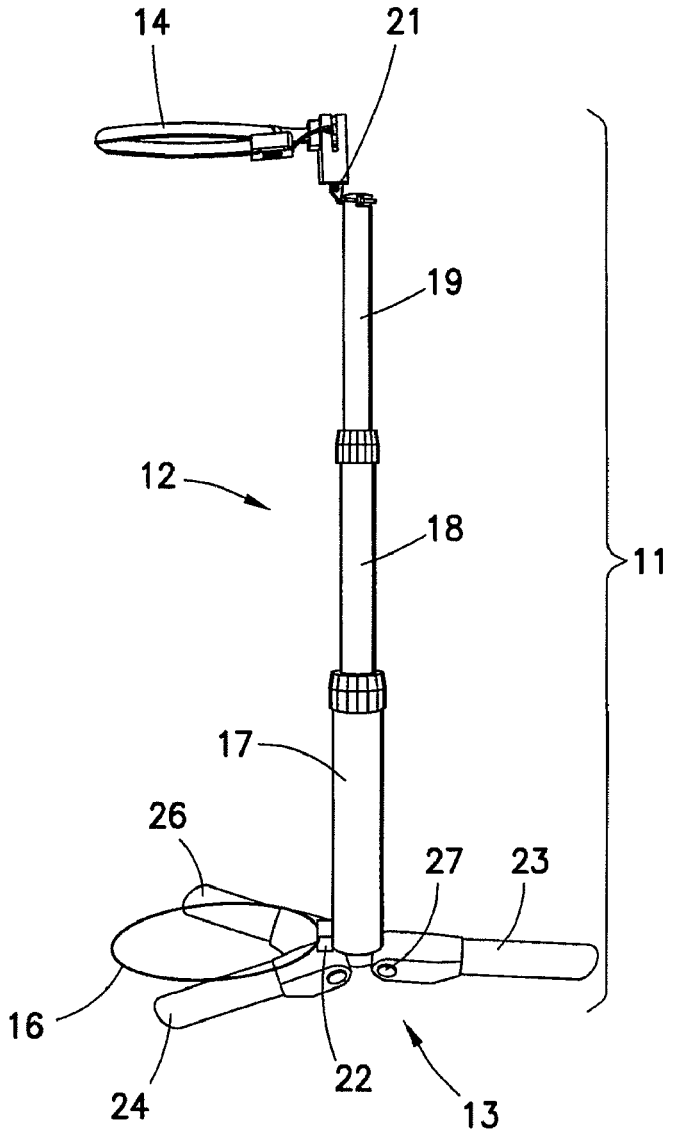
FIG. 1 is a perspective view of a portable tennis throw trainer constructed and arranged in accordance with to the invention.

FIG. 1 is an elevational view of a tennis throw trainer 11 including an adjustable extension pole 12 with a base 13. An upper toss hoop 14 is mounted at the top of pole 12 and a lower guide hoop 16 is mounted on pole 12 at base 13. The details of tennis throw trainer device 11 and its use will be described in more detail below.

Pole 12 is formed of telescoping sections to allow for adjusting the height of upper toss hoop 14 and for collapsing pole 13 for convenient storage. In the illustrated embodiment, pole 13 includes a lower section 17, a middle pole section 18 and an upper pole section 19. The adjustable height allows a player to throw the ball to the correct height and angle for serves. It is within the scope of the invention to have less or more that three pole sections, or to make pole 13 a fixed length, but a fixed length limits the use by people of varying height. Pole 13 can adjust from about four feet to twelve feet to suit every player's need. Pole 13 is formed of aluminum or a substantially rigid plastic material, such as polyvinyl chloride or polyethylene, such as used for a pool skimmer. This ensures that pole 13 is non-corroding.

Figure 2:
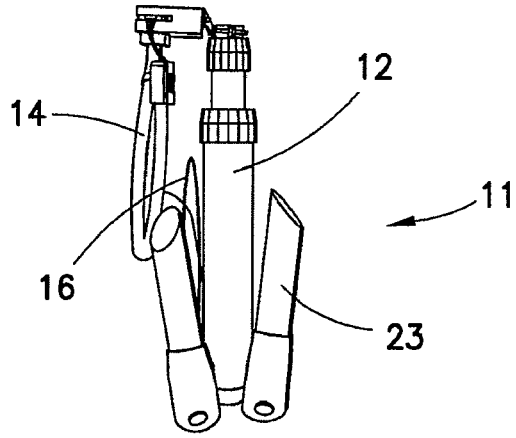
FIG. 2 is a plan view showing the portable tennis throw trainer of FIG. 1 in a collapsed condition for storage.
Figure 3:
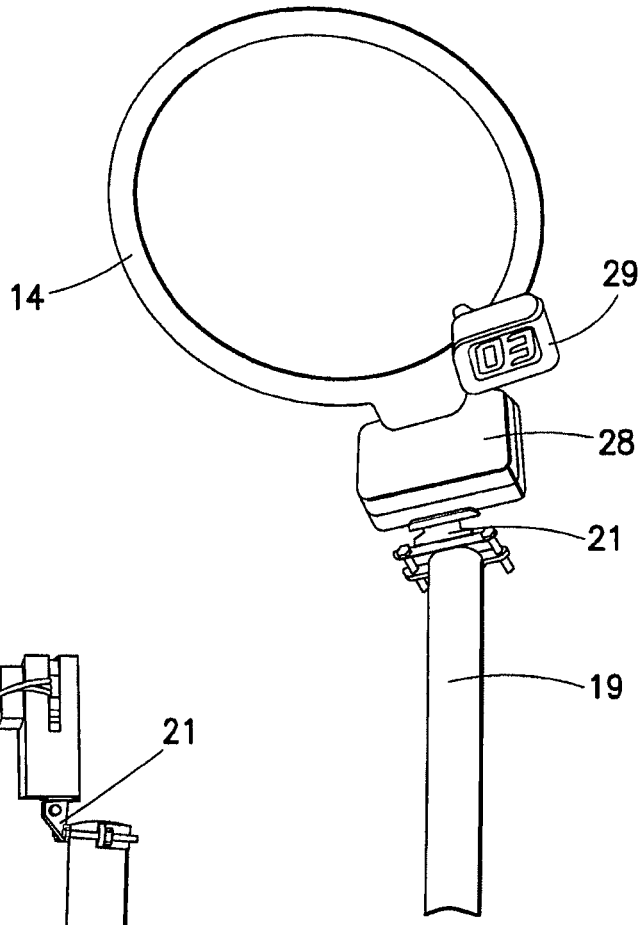
FIG. 3 is an perspective view of an upper toss hoop with a photo-sensor and indicator constructed and arranged in accordance with the invention.
Figure 4:
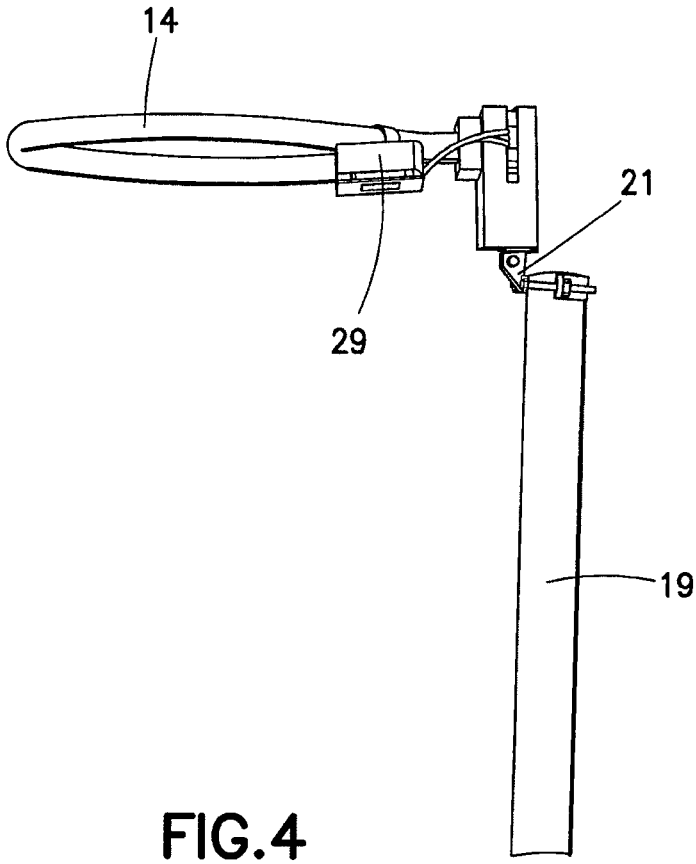
FIG. 4 is a side elevational view of the upper toss hoop and photo-sensor of FIG. 3.

Upper toss hoop 14 is mounted to upper pole section 19 by a hinge 21 and lower guide hoop 16 is mounted to lower pole section 17 by a hinge 22. This allows a user to collapse pole 12 and fold upper hoop 14 and lower hoop 16 for easy transport and storage. Base 13 is a tripod base with legs 23, 24 and 26 for stability. Each of base legs 23, 24 an 26 are also mounted to the lower end of bottom pole section 17 by a locking base leg hinge 27. This allows folding of base legs 23, 24 and 26 when collapsing trainer device 11 for storage and shown in FIG. 2.

Upper toss hoop 14 may have a photo-sensor 28 and a counter 29 to let the player know when the ball travels through hoop 14. The player will then be able to zero in on the exact speed with which to throw the ball so that it stops right at the correct height. Photo-sensor 28 and counter 29 is ideal because it doesn't require the player to reset a light or alarm each time he or she serves. He or she can simply look to see if the counter has increased to verify that the ball went through upper toss hoop 14. Sensing is done with photo sensor 28 that increases counter 29 with each pass through. Photo-sensor and counter can be powered by conventional flash light type batteries that can easily be replaced. The user does not have to charge the device nor does he or she have to rely on AC power.

Figure 5:
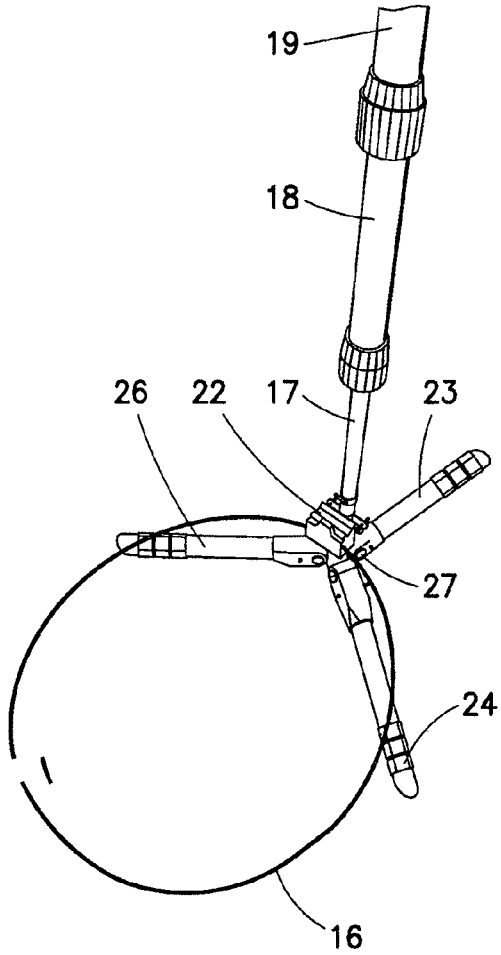
FIG. 5 is a perspective view of the lower guide hoop of the device of FIG. 1.
Figure 6:
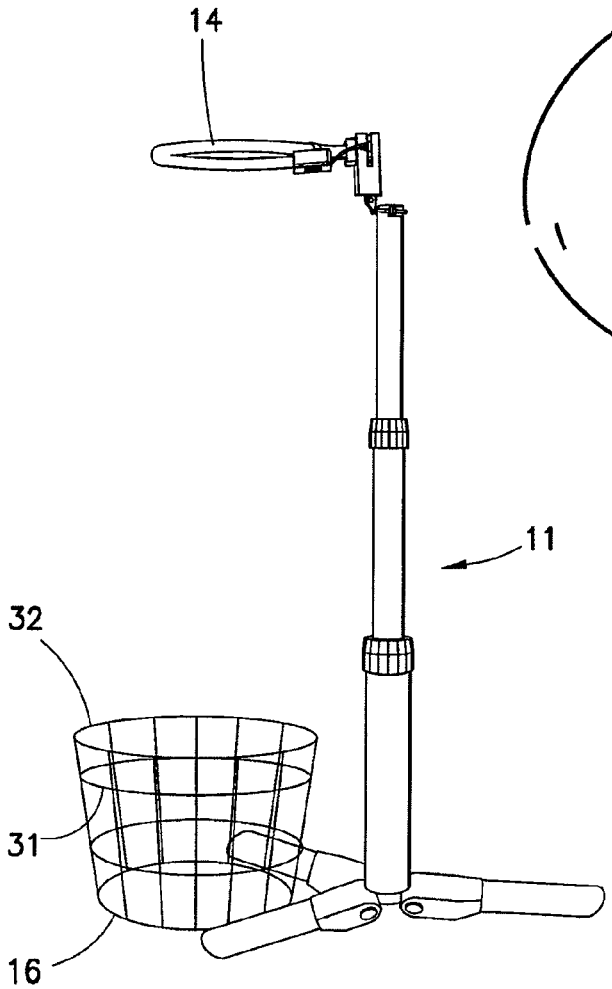
FIG. 6 is a perspective view of a portable tennis throw trainer with a ball catch container positioned at the lower guide hoop in accordance with to the invention.

Upper hoop 14 and lower hoop 16 fold away for easy storage and transport. The pole has three legs 23, 24 and 26 that also fold up so that players are more likely to bring toss training device 11 with them and use it more often to improve their serve and game. It is desirable to provide a pole to vary from about four feet to at least 10 feet so that a young child and a seven foot tall person can practice throws for his or her swing. Lower hoop 16 may include or be replace by an adjustable metal structure laundry basket 31 with a handle 32 as shown in FIG. 5.

This disclosure provides a lightweight and collapsible solution that is a cost-effective, reliable tennis throw training device.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawing (s) shall be interpreted as illustrative and not in a limiting sense.

The present invention may be embodied in other specific forms without departing from the spirit or essential attributes of the invention.

What is claimed is:

1. A tennis throw trainer, comprising:

a base;

a pole of suitable height for a player's height mounted to the base;

an upper toss hoop mounted to the top of the pole; and a lower guide hoop mounted to the bottom of the pole at the base;

the pole and upper toss hoop at a correct height and angle for serves with the upper hoop and lower hoop aligned vertically so that a player can determine that the ball is tossed to the correct height and is vertical when it passes through the upper toss hoop and lands in the lower guide hoop.

2. The throw trainer of claim 1, whereas the pole is adjustable in height.

3. The tennis throw trainer of claim 2, whereas the pole is adjustable between about four and twelve feet.

4. The tennis throw trainer of claim 3, whereas the adjustable pole is a telescoping pole.

5. The tennis throw trainer of claim 4, whereas the telescoping pole has three telescoping sections.

6. The tennis throw trainer of claim 2, whereas the upper hoop and lower hoop are mounted on the pole by hinges.

7. The tennis throw trainer of claim 1, whereas the pole is formed of aluminum.

8. The tennis throw trainer of claim 1, whereas the upper hoop and lower hoop are mounted on the pole by hinges.

9. The tennis throw trainer of claim 1, including a container positioned at the base below the upper toss hoop.

10. The tennis throw trainer of claim 1, further including a photo-sensor mounted on the upper toss hoop to indicate that a ball has passed through the hoop.

11. The tennis throw trainer of claim 10, further including an electric counter to indicate that a ball has passed through the hoop.

* * * * *